US007563493B2

(12) United States Patent
Shinohara et al.

(10) Patent No.: US 7,563,493 B2
(45) Date of Patent: Jul. 21, 2009

(54) INK JET RECORDING MEDIUM, METHOD OF INK JET IMAGE FORMATION AND PHOTOGRAPHIC PRINT

(75) Inventors: Satoru Shinohara, Miyagi (JP); Masanobu Hida, Miyagi (JP); Yumiko Nagano, Miyagi (JP)

(73) Assignee: Sony Corporation, Tokyo (JP)

( * ) Notice: Subject to any disclaimer, the term of this patent is extended or adjusted under 35 U.S.C. 154(b) by 593 days.

(21) Appl. No.: 10/502,720

(22) PCT Filed: Nov. 28, 2003

(86) PCT No.: PCT/JP03/15231

§ 371 (c)(1),
(2), (4) Date: Jul. 27, 2004

(87) PCT Pub. No.: WO2004/050378

PCT Pub. Date: Jun. 17, 2004

(65) Prior Publication Data

US 2005/0078162 A1 Apr. 14, 2005

(30) Foreign Application Priority Data

Nov. 29, 2002 (JP) ..... 2002-346694

(51) Int. Cl.
*B41M 5/50* (2006.01)

(52) U.S. Cl. ..... 428/32.18; 428/32.17; 428/32.21; 428/32.22

(58) Field of Classification Search ..... 428/32.17
See application file for complete search history.

(56) References Cited

U.S. PATENT DOCUMENTS 4,642,247 A * 2/1987 Mouri et al. ..... 427/214
5,670,242 A * 9/1997 Asano et al. ..... 428/32.24
6,086,985 A 7/2000 Shaw-Klein et al.
2001/0004487 A1* 6/2001 Kaneko et al. ..... 428/195
2002/0064631 A1* 5/2002 Wakabayashi et al. ..... 428/195

FOREIGN PATENT DOCUMENTS

| | | |
|---|---|---|
| EP | 0 524 635 | 1/1993 |
| EP | 0 605 840 | 7/1994 |
| JP | 08-127171 | 5/1996 |
| JP | 09-95043 | 4/1997 |
| JP | 11-334198 | 12/1999 |

(Continued)

OTHER PUBLICATIONS

Supplementary European Search Report dated Apr. 21, 2006.

*Primary Examiner*—Bruce H Hess
(74) *Attorney, Agent, or Firm*—Sonnenschein Nath & Rosenthal LLP

(57) ABSTRACT

An inkjet-recording medium has excellent various preservabilities, for example, the lightfastness of an image, resistance to bleeding under high-temperature and high-humidity conditions, and resistance to indoor fading and discoloration when a surface of a printing paper is subjected to laminating treatment. In an inkjet-recording medium having an ink-receiving layer on one surface of a base, the base having abilities to absorb and retain an ink solvent, a low oxygen-permeable resin layer preferably having an oxygen permeability of 10 cc/($m^2$·D·atm) at a temperature of 20° C. and at a relative humidity of 90% is provided on another surface of the base.

10 Claims, 1 Drawing Sheet

FOREIGN PATENT DOCUMENTS

| | | |
|---|---|---|
| JP | 2000-52637 | 2/2000 |
| JP | 2000-118129 | 4/2000 |
| JP | 2000-127613 | 5/2000 |
| JP | 2000-158806 | 6/2000 |
| JP | 2001-10222 | 1/2001 |
| WO | 98/52765 | 11/1998 |

* cited by examiner

INK JET RECORDING MEDIUM, METHOD OF INK JET IMAGE FORMATION AND PHOTOGRAPHIC PRINT

BACKGROUND OF THE INVENTION

The present invention relates to an inkjet-recording medium, a method for forming inkjet print with the inkjet-recording medium, and inkjet print produced by the method for forming an inkjet print.

One of the processes for outputting image data and character code data, which are produced by, for example, personal computers, onto recording media such as paper and overhead transparency films includes inkjet recording in which an image is produced by discharging an ink containing a water-soluble dye to a surface of a recording medium through a recording nozzle of a printer, the recording nozzle being driven by, for example, an electric field, heat, or pressure.

Media including an ink-receiving layer formed on a surface of a base have been used for such inkjet recording. Paper has been used as such a base for a long time. In recent years, there have been demands for an inkjet-recording medium that can be printed on with near photographic-quality. Hence, for example, bases made of resin films such as polyester films having high surface smoothness and excellent water-resistance and bases made of resin-coated paper having polyolefin resins coated on both sides of the papers have become more widely used.

To quickly absorb inks and to prevent inks from overflowing and bleeding even when printed dots overlap each other, ink-receiving layers having porous structures produced by coating bases with binder resins, for example, polyvinyl alcohols containing fillers such as fine particle alumina hydrate or fine particle silica, have been used.

Dye-sublimation thermal transfer printing has generally been performed so as to form an image-protecting layer made of a transparent thermoplastic resin on a dye-receiving layer with an image, thus improving lightfastness and resistance to indoor fading and discoloration. For ink-jet recording, it has also been attempted to form such an image-protecting layer on an ink-receiving layer with an image (Japanese Unexamined Patent Application Publication No. 8-252985, in particular, Claim 1, paragraph [0001], and the like).

However, as is the case with such dye-sublimation thermal transfer printing, when an image-protecting layer is disposed on an ink-receiving layer with an image formed by inkjet recording, problems with, for example, a decrease in lightfastness and an increase in ink bleeding during storage have sometimes arisen. In particular, these problems have been pronounced when using a base that cannot absorb water (for example, a resin-coated (RC) paper base or a polyethylene terephthalate (PET) base). When a water-absorbing paper base is used, the degree of reduction in the lightfastness of an image and the occurrence of ink bleeding are low compared to the case with a base that cannot absorb water. However, there has been a problem that the effect of improving indoor fading and discoloration is unsatisfactory.

SUMMARY OF THE INVENTION

It is an object of the present invention to solve the above-described problems of the known art, that is, to provide an inkjet-recording medium having excellent preservability, for example, the lightfastness of an image, resistance to bleeding under high-temperature and high-humidity conditions, and resistance to indoor fading and discoloration of an image, when an image-protecting layer is disposed on an ink-receiving layer with an image on an inkjet-recording medium by inkjet recording.

The inventors have investigated a cause of a decrease in the lightfastness of an image and an increase in ink bleeding during storage when an image-protecting layer is disposed on an ink-receiving layer with an image formed by inkjet recording. As a result, the inventors found that the decreased lightfastness and the increased bleeding are caused by a remaining ink solvent (mainly a water-containing solvent) of an inkjet ink in an ink-receiving layer of an inkjet-recording medium.

For example, when a base that cannot absorb water, for example, an RC paper base or a PET base is used as a base for an inkjet-recording medium, residual ink solvent in an ink-receiving layer after laminating an image-protecting layer has no way out and remains in the ink-receiving layer. As a result, the lightfastness of an image deteriorates, and bleeding occurs under high-temperature and high-humidity conditions.

When a base which allows air to permeate through the back surface of the base is used, residual ink solvent in an ink-receiving layer after laminating an image-protecting layer passes through the base and then evaporates from the back surface of the base; hence, the deterioration of the lightfastness of an image and the occurrence of bleeding of an image are suppressed compared to the case with a base that cannot absorb water. However, the effect of improving indoor fading and discoloration of an image is reduced compared to the case with a base that cannot absorb water.

The reason for this is the following: Since a formed image-protecting layer blocks air permeation through the front surface (a surface near an ink-receiving layer) of an inkjet-recording medium to keep pigments from contact with air, pigment deterioration from the front surface is suppressed. However, since printing paper which allows air to permeate through the back surface of the printing paper is used, various oxidizing gases and ozone, which are contained in air, reach the ink-receiving layer through the back surface, thus impairing the pigments that constitute an image.

The inventors found the following: On the basis of the above-described results, a base having the functions of absorbing and retaining residual ink solvent in an ink-receiving layer (in other words, a base that can absorb above a certain volume of liquid) is used as the base of an inkjet-recording medium having an ink-receiving layer disposed on one surface of the base. In addition, a low oxygen-permeable resin layer having very low oxygen permeability is disposed on another surface of the base. As a result, the preservability of an image formed by inkjet recording can be improved. This finding has led to the completion of the present invention.

That is, the present invention provides an inkjet-recording medium having an ink-receiving layer disposed on one surface of a base, the inkjet-recording medium including a base with an ability to absorb an ink solvent and including a low oxygen-permeable resin layer disposed on another surface remote from the ink-receiving layer of the base, the volume of liquid absorbed by the base according to Japan Technical Association of the Pulp and Paper Industry (TAPPI) Nos. 51 to 87 being preferably 0.5 $ml/m^2$ or more, the oxygen permeability of the low oxygen-permeable resin layer being preferably 10 $cc/(m^2 \cdot D \cdot atm)$ or less at a temperature of 20° C. and at a relative humidity of 90%.

As described above, in an inkjet-recording medium of the present invention, since a base in contact with an ink-receiving layer has functions of absorbing and retaining residual ink solvent moved from an ink-receiving layer, the deterioration of lightfastness of an image and the occurrence of bleeding of an image under high-temperature and high-humidity conditions, which are caused by the residual ink solvent in the ink-receiving layer, can be suppressed. Furthermore, since a low oxygen-permeable resin layer is disposed beneath the back surface of the base, the phenomenon of indoor fading and discoloration of an image attributed to various oxidizing gases that are contained in air can be suppressed.

Furthermore, the present invention provides a method for forming an inkjet print, the method including the steps of: forming an inkjet image at an ink-receiving layer of the inkjet-recording medium described above; laminating an image-protecting layer principally composed of a thermoplastic resin on the surface of the ink-receiving layer with the inkjet image. The present invention also provides inkjet print formed by the method for forming the inkjet print.

DETAILED DESCRIPTION OF THE PRESENTLY PREFERRED EMBODIMENTS

Figure 1:
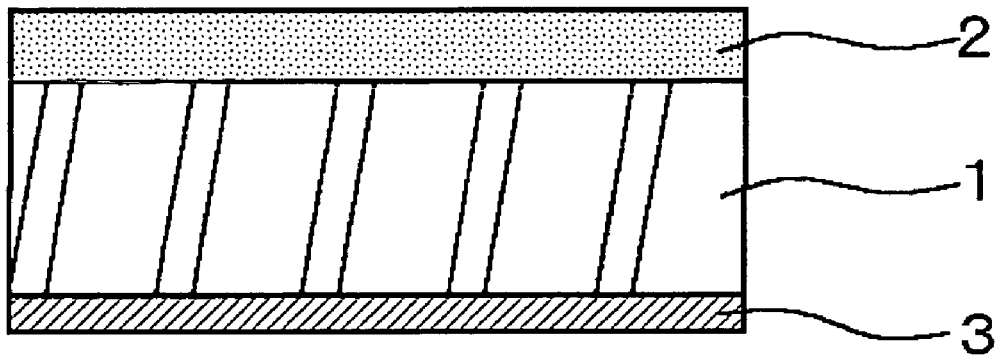
FIG. 1 is a cross-sectional view of an inkjet-recording medium according to the present invention.

As shown in FIG. 1, an inkjet-recording medium used for inkjet recording includes an ink-receiving layer 2 disposed on one surface of a base 1, a low oxygen-permeable resin layer 3 disposed on another surface of the base 1, and, if necessary, an adhesive layer (not shown) disposed between the base 1 and the ink-receiving layer 2 in order to improve their adhesion strength, provided that the effect of the present invention is not impaired.

A base having functions of absorbing and retaining an ink solvent remaining in the ink-receiving layer 2 is used for the base 1. When the ink-receiving layer 2 is subjected to inkjet recording, the base 1 of the inkjet-recording medium of the present invention can absorb and retain an ink solvent remaining in the ink-receiving layer 2. Therefore, the deterioration of the lightfastness of an image and the occurrence of bleeding of an image, which are caused by the residual ink solvent in the ink-receiving layer 2 can be suppressed.

Furthermore, in an inkjet-recording medium of the present invention, the low oxygen-permeable resin layer 3 is disposed beneath the back surface, i.e., the surface remote from the ink-receiving layer 2 of the base 1, thus blocking the permeation of air through the back surface.

The base 1 of an inkjet-recording medium according to the present invention has an ability to absorb and retain a residual ink solvent in the ink-receiving layer 2 as described above. In particular, a base is used in which the volume of liquid absorbed by the base according to Japan TAPPI Nos. 51 to 87 is 0.5 $ml/m^2$ or more.

Examples of such a base 1 include paper bases and porous resin bases.

Examples of the paper bases include, for example, base papers manufactured by mixing wood pulps, known pigments, and at least one additive, the wood pulps and the known pigments being main components, the additives being, for example, a binder, a sizing agent, a fixing agent, a yield-improving agent, a cationizing agent, and a paper-strengthening agent, with an apparatus, for example, a Fourdrinier paper machine, a cylinder paper machine, or a twin-wire paper machine, the wood pulps being, for example, chemical pulps, for example, laubholz bleached kraft pulp (LBKP), or nadelholz bleached kraft pulp (NBKP); mechanical pulps, for example, groundwood pulp (GP), pressurized groundwood pulp (PGW), refiner mechanical pulp (RMP), thermomechanical pulp (TMP), chemi-thermo mechanical pulp (CTMP), chemi-mechanical pulp (CMP), or chemi-groundwood pulp (CGP); or waste paper pulps such as deinked pulp (DIP). Examples of paper bases further include, for example, base papers with anchor coats, base papers subjected to size press with starch or polyvinyl alcohol, and coated papers, for example, art paper, coated paper, and cast coated paper, the coated papers having coat layers disposed on such base papers with anchor coats or disposed on such base papers subjected to such size press with starch or polyvinyl alcohols. These paper bases may be subjected to calendering, for example, machine calendering, thermal gradient (TG) calendering, or soft calendering in order to control the smoothness.

For the porous resin bases, bases similarly structured to porous resin bases that have conventionally been used for inkjet-recording media may be used (Japanese Unexamined Patent Application Publication No. 2001-253166).

Such a porous resin base may be manufactured by the known art, for example, known film-forming techniques or a combination thereof. For example, a film orientation process in which pores are generated during drawing, a rolling process in which pores are generated during rolling, a calendering process, a foaming process which uses a foaming agent, a process of using porous particles, a solvent extraction process, and a process of dissolving and extracting mixed components, may be employed (Japanese Unexamined Patent Application Publication No. 2001-139710, in particular, paragraph [0047]).

The ability to absorb and retain an ink solvent of the base 1 is mainly based on the presence of pores (or voids) in the base. In the present invention, it is preferable not to prevent an ink solvent from permeating into the base 1 by forming the pores such that the pores (or voids) in such a base 1 are not much larger than the diameter of the pores disposed in the ink-receiving layer 2.

Regarding the permeability of the base 1 to an ink solvent of the present invention, along the thickness direction of the base 1, a first region far from the ink-receiving layer 2 (hereinafter, referred to as "first region") and a second region near the ink-receiving layer 2 (hereinafter, referred to as "second region") have different permeabilities to each other, particularly, the first region of the base 1 preferably has a greater permeability to the ink solvent than that of the second region.

In order that the base 1 has a different permeability to a solvent along the thickness direction of the base 1, for example, by decreasing the pore size in the base 1 with receding from the ink-receiving layer 2, the capillary force of the first region of the base 1 may be enhanced. Alternatively, the first region of the base 1 may have a greater capacity to absorb an ink solvent.

Since the first region of the base 1 has the ability to absorb a larger volume of an ink solvent and has higher permeability, the ink solvent absorbed by the base 1 is stably retained in the base 1. An ink solvent that has once moved to and been absorbed in the first region of the base 1 hardly returns to the second region because of the higher permeability to an ink solvent and a larger capacity to absorb an ink solvent in the first region of the base 1. Consequently, an ink solvent is retained in the first region of the base 1, thus decreasing the amount of residual ink solvent in the ink-receiving layer 2.

To absorb and retain a larger amount of ink solvent in the first region of the base 1, for example, when the base 1 is made by laminating a plurality of paper bases, the base 1 may have a permeability gradient by changing the physical properties (for example, Stockigt sizing degree, porosity, and fiber length) of each paper base. As a result, the first region of the base 1 can absorb and retain a larger amount of ink solvent.

To change the porosity of a paper base, for example, a process of changing an amount of foamable microcapsules added during paper making may be employed according to, for example, a process of using foamable microcapsules disclosed in Japanese Unexamined Patent Application Publication No. 7-205543. When the base 1 is made by laminating a plurality of porous resin bases, changes in the above-described manufacturing conditions lead to variations of the pore diameters and the porosities of these porous resin bases. By laminating these porous resin bases, the first region of the base 1 can absorb and retain a larger amount of ink solvent.

The low oxygen-permeable resin layer 3 of the present invention has an oxygen permeability of up to 10 cc/($m^2$·D·atm) at a temperature of 20° C. and at a relative humidity of 90%. The low oxygen-permeable resin layer 3 is composed of a resin with a thickness that exhibits a desired permeability and is produced by a known process, wherein the resin is at least one selected from the group consisting of a polyolefin resin, a (meth)acrylic acid resin, a styrene-butadiene resin, a vinyl chloride resin, a styrene-acrylic resin, a butadiene resin, a styrene resin, a phenolic resin, a silicone resin, a urethane resin, and an epoxy resin.

Paper coated with a polyolefin resin is manufactured by, for example, melt extrusion coating in which traveling paper is coated with a polyolefin resin melted by heating or emulsion coating in which a polyolefin emulsion is applied and dried. To improve adhesion between the polyolefin resin and the base paper, the base paper is preferably subjected to surface activation treatment, for example, corona discharge treatment, flame treatment, or the formation of an anchor layer. Examples of the polyolefin resins include polymers or copolymers prepared by polymerizing or copolymerizing, for example, ethylene, propylene, 1-butene, 1-pentene, 1-hexene, 4-methyl-1-pentene, 1-heptene, 1-octene, and 1-nonene.

The low oxygen-permeable resin layer 3 may contain various additives, for example, pigments, dye, lubricants, antioxidants, ultraviolet absorbers, plasticizers, adhesives, and curing agents.

The ink-receiving layer 2 similarly structured to an ink-receiving layer that has conventionally been used for inkjet-recording media may be used. An example of the ink-receiving layer 2 is a porous ink-receiving layer formed by coating a suspension prepared by dispersing fillers, for example, fine particle silica or fine particle alumina into water-soluble binders, for example, polyvinyl alcohol, and dried by a known coating process.

The ink-receiving layer 2 may be subjected to cast treatment to impart gloss to its surface.

When an adhesive layer is disposed between the base 1 and the ink-receiving layer 2, the adhesive layer may be composed of, for example, an adhesive containing a latex such as a styrene-butadiene latex, an acrylonitrile-butadiene latex, an acrylic latex, or a vinyl acetate latex.

The back surface of printing paper may be formed by laminating, for example, paper on the surface of the base 1 remote from the ink-receiving layer 2 so that any letter or image can be written or drawn on this surface. A desired known process, for example, pasting with an adhesive or hot-melt adhesive may be used for the lamination.

A method for forming an inkjet print may be preferably applied to an inkjet-recording medium of the present invention described above, the method including the steps of: forming an inkjet image in an ink-receiving layer in the usual manner; and laminating an image-protecting layer principally composed of a thermoplastic resin on the surface of the ink-receiving layer with the inkjet image. Such an image-protecting layer may be laminated by the following procedure: At least one thermoplastic resin layer or at least one layer containing thermoplastic resin particles is formed on a heat-resistant base composed of, for example, polyethylene terephthalate (PET) or polyethylene naphthalate (PEN). This formed layer is disposed so as to face an ink-receiving layer and then heated from a face remote from the thermoplastic resin layer or the layer containing thermoplastic resin particles of the heat-resistant base with, for example, a heat roller or a thermal head, thus thermally transferring to the ink-receiving layer. The image-protecting layer is preferably composed of a plurality of sublayers and preferably has a low glass transition temperature to improve the adhesion of a sublayer in contact with the surface of the ink-receiving layer.

As described above, an inkjet print manufactured by the method for forming the inkjet print has excellent preservability, for example, the lightfastness of an image, resistance to bleeding under high-temperature and high-humidity conditions, and resistance to indoor fading and discoloration.

The present invention will now be described in detail based on examples.

EXAMPLE 1

Polyethylene coating was formed on the back surface of a coated paper having a calendered surface and having a thickness of about 100 μm to form a low oxygen-permeable resin layer having a thickness of about 15 μm, the volume of liquid absorbed by the coated paper according to Japan Technical Association of the Pulp and Paper Industry (TAPPI) Nos. 51 to 87 being about 0.5 ml/$m^2$, the oxygen permeability of the low oxygen-permeable resin layer being about 10 cc/($m^2$·D·atm) at a temperature of 20° C. and at a relative humidity of 90%. In this way, a base was manufactured.

Next, a surface of the base remote from the surface of the low oxygen-permeable resin layer was subjected to calendering. A suspension, which is shown in Table 1, for forming an ink-receiving layer was prepared such that the content of silica produced by a vapor phase process (solid content) was nine percent by weight. And then the suspension was applied on the surface of the base and dried such that a layer to be formed has a dry thickness of 35 μm, thus resulting in an ink-receiving layer. Consequently, an inkjet-recording medium was prepared.

TABLE 1

(Composition of suspension for forming ink-receiving layer)

| Content | Parts by weight |
|---|---|
| Silica A-300 produced by vapor phase process (manufactured by NIPPON AEROSIL CO., LTD.) | 100 |
| Dimethyldiallylammonium chloride homopolymer SHALLOL DC902P (manufactured by DAIICHI KOGYO SEIYAKU CO., LTD.) | 5 |
| Polyvinyl alcohol PVA235 (manufactured by KURARAY CO., LTD.) | 25 |
| Borax | 6 |
| Acetic acid:water:isopropyl alcohol = 2:98:20 (weight ratio) | (Amount such that solid content of silica produced by vapor phase process is 9 percent by weight.) |

EXAMPLE 2

Polyethylene coating was formed on the back surface of foamed polyethylene terephthalate (PET) having an average pore diameter of 20 to 30 μm and having a thickness of about 100 μm to form a low oxygen-permeable resin layer having a thickness of about 15 μm, the volume of liquid absorbed by the coated paper according to Japan TAPPI Nos. 51 to 87 being about 0.5 ml/$m^2$, the oxygen permeability of the low oxygen-permeable resin layer being about 10 cc/($m^2$·D·atm) at a temperature of 20° C. and at a relative humidity of 90%. In this way, a base was manufactured. An ink-receiving layer was then formed as in Example 1. Consequently, an inkjet-recording medium was prepared.

COMPARATIVE EXAMPLE 1

A base was composed of a coated paper with a single-sided resin coating, the entire coated paper having a thickness of about 150 μm and the resin coating having a thickness of about 50 μm, the volume of liquid absorbed by the coated paper according to Japan TAPPI Nos. 51 to 87 being about 0 ml/$m^2$. The oxygen permeability of the resin coating was about 0 cc/($m^2$·D·atm) at a temperature of 20° C. and at a relative humidity of 90%.

An ink-receiving layer was formed on a surface of the base remote from the resin coating as in Example 1. Consequently, an inkjet-recording medium was manufactured.

COMPARATIVE EXAMPLE 2

An ink-receiving layer was formed as in Example 1, but a low oxygen-permeable resin layer was not provided on a coated paper. Consequently, an inkjet-recording medium was manufactured.

(Evaluation)

For ink-receiving layers of inkjet-recording media manufactured in Examples and Comparative Examples, images including gradations for each of magenta and cyan ink were printed by an inkjet printer (PM-950C manufactured by Seiko Epson Corporation).

Next, a coating having a thickness of about 50 μm made of a thermoplastic (meth)acrylic resin having residues capable of absorbing ultraviolet was formed on a surface of a PET base having a thickness of 30 μm, thus resulting in an image-protecting sheet provided with an image-protecting layer disposed on a surface of the PET base.

The resulting image-protecting sheet and an inkjet-recording medium with an image were stacked such that the image-protecting layer of the image-protecting sheet was opposed to the ink-receiving layer of the inkjet-recording medium. The resulting stack was introduced into the nip between a steel roller, which was heated at 140° C., having a diameter of 80 mm disposed at the side of the image-protecting sheet and a rubber roller, which was heated at 140° C., having a diameter of 50 mm disposed at the side of the inkjet-recording medium, to be thermocompressively bonded with each other under the following conditions: a nip load of 120 N; and a feeding speed of 10 mm/s.

By peeling off the PET base of the image-protecting sheet immediately after passing through the nip between these rollers, the image-protecting layer was transferred and bonded on the ink-receiving layer of the inkjet-recording medium, thus resulting in an inkjet print.

The resulting prints were evaluated based on the following: "lightfastness of the image", "bleeding of the image", and "indoor fading and discoloration". Table 2 shows the results.

[Lightfastness of the Image]

An inkjet print before providing an image-protecting layer (unlaminated inkjet print) and an inkjet print after providing an image-protecting layer (laminated inkjet print) were irradiated with light for 60 hours with an Atlas light fastness tester. The total irradiation was 90 kJ/$m^2$. The residual rate of an area printed with a magenta ink of each of the inkjet prints was measured, the area having an optical density of around one before irradiation. The residual rate was defined by the following equation: (optical density after irradiation)/(optical density of before irradiation) (%). A greater residual rate of the laminated inkjet print compared to that of the unlaminated inkjet print indicated that the laminated inkjet print had more excellent lightfastness.

[Bleeding of the Image]

Unlaminated and laminated inkjet prints were maintained for four days at a temperature of 30° C. and at a relative humidity of 95%. And then, a change in the degree of bleeding at the printed area of the laminated inkjet print with reference to the degree of bleeding at the printed area of the unlaminated inkjet print was visually evaluated. It is preferable to decrease bleeding.

[Indoor Fading and Discoloration (Ozone Resistance)]

Unlaminated and laminated inkjet prints were exposed to an atmosphere containing 0.5 ppm of ozone for 24 hours. A residual rate of an area printed with cyan ink was measured. The residual rate was defined by the following equation: (optical density after exposure)/(optical density before exposure) (%). A greater residual rate of the laminated inkjet print compared to that of the unlaminated ink-jet print indicated that the laminated inkjet print had more excellent indoor fading and discoloration.

TABLE 2

| | Lightfastness of the image | | Bleeding of the | Indoor fading and discoloration | |
|---|---|---|---|---|---|
| | Unlaminated | Laminated | image | Unlaminated | Laminated |
| Example 1 | 78 | 84 | Decreased | 84 | 100 |
| Example 2 | 78 | 83 | Decreased | 84 | 100 |
| Comparative example 1 | 78 | 70 | Increased | 84 | 100 |
| Comparative example 2 | 78 | 83 | Decreased | 80 | 89 |

As shown in Table 2, the inkjet-recording media of Examples 1 and 2, i.e., each of the inkjet-recording media having a base with abilities to absorb and retain an ink solvent and having a low oxygen-permeable resin layer exhibited excellent results obtained from each of the evaluation items of "Lightfastness of the image", "Bleeding of the image", and "Indoor fading and discoloration".

On the other hand, the inkjet-recording medium of Comparative example 1, i.e., the inkjet-recording medium having a base without abilities to substantially absorb and retain an ink solvent indicated undesirable results obtained from the evaluation items of "Lightfastness of the image" and "Bleeding of the image". The inkjet-recording medium of Comparative example 2, i.e., the inkjet-recording medium having a base with abilities to absorb and retain an ink solvent and having no low oxygen-permeable resin layer exhibited an unsatisfactory effect of improving the indoor fading and discoloration compared to the case in Examples 1 and 2.

INDUSTRIAL APPLICABILITY

The present invention can be applied to inkjet-recording media used to, for example, inkjet printers employing inkjet recording that produces an image by discharging an ink to a surface of a recording medium through a recording nozzle driven by, for example, an electric field, heat, or pressure; methods for forming inkjet prints with the inkjet-recording media; and ink-jet prints produced by the methods for forming the inkjet prints.

The invention claimed is:

1. An inkjet-recording medium comprising:

a base having a first surface and a second surface opposite the first surface;

an ink-receiving layer formed on said first surface of the base, the ink-receiving layer being able to absorb an ink solvent; and a low oxygen-permeable resin layer provided on said second surface of the base, the low oxygen-permeable resin layer having a permeability of about 10 cc/($m^2$·D·atm) or less thereby allowing only a very low amount of oxygen to pass through the low oxygen-permeable resin layer to the base for preserving an image formed in the medium during use of the medium, wherein, the base has a first region adjacent said second surface of the base and a second region adjacent said first surface of the base, the permeability of the first region to the ink solvent being greater than that of the second region, and the permeability of the low oxygen-permeable resin layer is about 10 cc/($m^2$·D·atm) at a temperature of 20° C. and a relative humidity of 90%.

2. The inkjet-recording medium according to claim 1, wherein the base comprises paper or a porous resin.

3. The inkjet-recording medium according to claim 1, wherein the low oxygen-permeable resin layer has a first surface positioned immediately adjacent the second surface of the base and an exposed second surface opposite the first surface of the oxygen-permeable resin layer.

4. The inkjet-recording medium according to claim 1, wherein the base has a volumetric liquid absorption value of about 0.5 ml/$m^2$.

5. The inkjet-recording medium according to claim 1, further comprising an adhesive positioned between the base and the ink-receiving layer.

6. The inkjet-recording medium according to claim 5, wherein said adhesive is a latex selected from a group of latexes consisting of styrene-butadienne latex, acrylonitrile-butadiene latex, acrylic latex, and vinyl acetate latex.

7. The inkjet-recording medium according to claim 1, the base and the ink-receiving layer are porous and the size of pores of the base are a size of pores of the ink-receiving layer.

8. The inkjet-recording medium according to claim 1, wherein the base has a first region adjacent said second surface and a second region adjacent said first surface and the base has a larger capacity to hold the ink solvent in the first region of the base than in the second region of the base.

9. The inkjet-recording medium according to claim 1, wherein the higher permeability of the first region of the base over the second region of the base results from changing at least one physical characteristic of the base selected from a group of physical characteristics consisting of Stockigt sizing of the base, porosity of the base, and fiber length of the base.

10. An inkjet-recording medium comprising:

a base having a first surface and a second surface opposite the first surface;

an ink-receiving layer formed on said first surface of the base, the ink-receiving layer being able to absorb an ink solvent; and a low oxygen-permeable resin layer provided on said second surface of the base, the low oxygen-permeable resin layer having a permeability of about 10 cc/($m^2$·D·atm) or less thereby allowing only a very low amount of oxygen to pass through the low oxygen-permeable resin layer to the base for preserving an image formed in the medium during use of the medium, wherein said base is porous and pores of the base decrease in size toward the second surface of the base.

* * * * *